US011105580B2

(12) United States Patent
Romero

(10) Patent No.: US 11,105,580 B2
(45) Date of Patent: Aug. 31, 2021

(54) PIVOTING LIMB PAD ASSEMBLY FOR AN ARCHERY BOW

(71) Applicant: Martin Outdoors, LLC, Walla Walla, WA (US)

(72) Inventor: Scott Romero, Newport, NC (US)

(73) Assignee: Martin Outdoors, LLC, Walla Walla, WA (US)

( * ) Notice: Subject to any disclaimer, the term of this patent is extended or adjusted under 35 U.S.C. 154(b) by 0 days.

(21) Appl. No.: 16/732,197

(22) Filed: Dec. 31, 2019

(65) Prior Publication Data

US 2020/0208939 A1 Jul. 2, 2020

Related U.S. Application Data

(60) Provisional application No. 62/786,696, filed on Dec. 31, 2018.

(51) Int. Cl.

| | |
|---|---|
| ***F41B 5/00*** | (2006.01) |
| ***F41B 5/14*** | (2006.01) |
| ***F41B 5/10*** | (2006.01) |

(52) U.S. Cl.

CPC ..... *F41B 5/1426* (2013.01); *F41B 5/00* (2013.01); *F41B 5/10* (2013.01)

(58) Field of Classification Search

CPC ..... F41B 5/00; F41B 5/10

See application file for complete search history.

(56) References Cited

U.S. PATENT DOCUMENTS

| | | | | |
|---|---|---|---|---|
| 5,231,970 | A * | 8/1993 | Ploot | F41B 5/10 124/23.1 |
| 5,339,790 | A * | 8/1994 | Smith | F41B 5/10 124/23.1 |
| 8,408,192 | B2 * | 4/2013 | McPherson | F41B 5/10 124/23.1 |
| 8,459,244 | B2 * | 6/2013 | Yehle | F41B 5/0094 124/25.6 |
| 8,844,508 | B2 * | 9/2014 | Sims | F41B 5/10 124/25 |
| 2017/0030674 | A1 * | 2/2017 | Ell | F41B 5/10 |

* cited by examiner

*Primary Examiner* — John A Ricci

(74) *Attorney, Agent, or Firm* — Mark A. Pitchford; Eric B. Fugett; Pitchford Fugett, PLLC

(57) ABSTRACT

A limb pad assembly for an archery bow includes an elongated body that articulates about a lateral axis and/or has a curved working surface that contacts a limb of the bow spaced from a riser of the bow by the limb pad assembly. The articulation and/or curved working surface serve to distribute stress along the limb during drawing and firing of the bow to reduce noise and vibration during firing of the bow and to reduce material fatigue in the bow limb, preventing premature limb failure.

18 Claims, 4 Drawing Sheets

PIVOTING LIMB PAD ASSEMBLY FOR AN ARCHERY BOW

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims priority to U.S. Provisional patent application 62/786,696 entitled "PIVOTING LIMB PAD ASSEMBLY FOR AN ARCHERY BOW" filed on Dec. 31, 2018.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to the field of archery. More specifically, the present invention relates to a limb pad assembly in a compound archery bow.

Limb pads are secured between the ends of the riser and limbs in some convention compound archery bows. Limb pads reduce noise during shooting or firing of the bow and adjust limb angle. Prior art limb pads typically consist of a thin piece of a resilient material (e.g., plastic or Teflon) attached to the riser end or limb where the limb would otherwise contact the riser. These limb pads do nothing to distribute the stress placed upon a limb by the riser contact point during drawing or tensioning of the bow. This stress is typically localized or focused to a small portion of the limb (where the limb contacts the riser), making the limbs susceptible to material fatigue and, ultimately, failure as the draw weight of the bow is increased and load cycles of the limbs are increased. Accordingly, what is needed are improvements in archery bows.

BRIEF SUMMARY OF THE INVENTION

Aspects of the present invention provide a limb pad assembly for an archery bow. The limb pad assembly includes an elongated body that articulates about a lateral axis and/or has a curved working surface that contacts a limb of the bow spaced from a riser of the bow by the limb pad assembly. The articulation and/or curved working surface serve to distribute stress along the limb during drawing and firing of the bow to reduce noise and vibration during firing of the bow and to reduce material fatigue in the bow limb, preventing premature limb failure.

In one aspect, a limb pad assembly of an archery bow includes an elongated body. The elongated body is configured to space a limb of the archery bow from a first end of a riser the bow is assembled. The limb extends longitudinally when the archery bow is assembled. The elongated body has a working surface configured to contact the limb of the archery bow when the archery bow is assembled. The working surface of the elongated body is curved as the working surface extends longitudinally.

In another aspect, and archery bow includes a limb pad assembly. The limb pad assembly includes an elongated body. The elongated body is configured to space a limb of the archery bow from a first end of a riser the bow is assembled. The limb extends longitudinally when the archery bow is assembled. The elongated body has a working surface configured to contact the limb of the archery bow when the archery bow is assembled. The working surface of the elongated body is curved as the working surface extends longitudinally.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
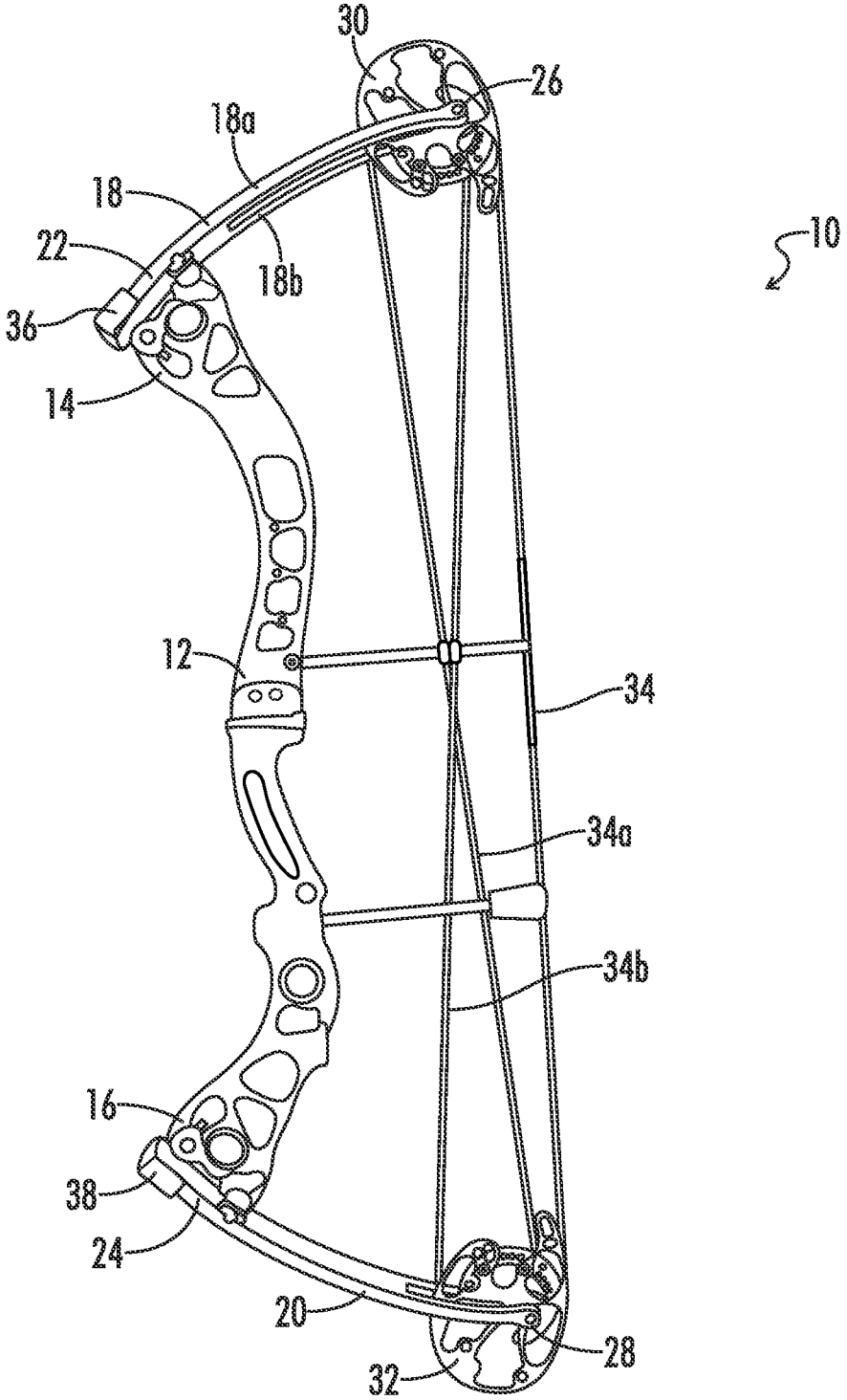
FIG. 1 is a side perspective view of a compound archery bow including a limb pad assembly according to one embodiment of the invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright position of a modern compound archery bow is when held by a user in a vertical orientation ready to draw and/or release (see FIG. 1). As used herein, archery bow refers to modern compound single limb or split limb bows or a compound crossbow. The upright position of a crossbow as described herein is when held by a user generally vertically (i.e., sideways) such that the limbs extend generally vertically. Forward or proximal is generally the direction in which a projectile is propelled from the archery bow when shot, and rearward or distal is generally toward a user shooting the archery bow. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring to FIG. 1, an archery bow 10 includes a riser 12 having an upper end 14 and a lower end 16. An upper limb 18 has a proximal end 22 coupled to the upper end 14 of the riser 12 and a distal end 26 rotatably coupled to a first rotatable member 30. A lower limb 20 has a proximal end 24 coupled to the lower end 16 of the riser 12 and a distal end 28 rotatably coupled to a second rotatable member 32. The proximal ends 22, 24 of the limbs 18, 20 are coupled to the upper and lower ends 14, 26, respectively, of the riser 12 by limbs caps 36, 38.

In some embodiments, each limb of the bow 10 is a split limb 18 comprising two limb pieces 18*a*, 18*b* oriented in parallel with one another. The limb pieces 18*a*, 18*b* define a space between them in which the rotatable member 30 is receivable. A drawstring 34 (i.e., string or bowstring) is connected between (e.g., wound around) the first and second rotatable members 30, 32 such that when the drawstring 34 is drawn back prior to shooting an arrow, the drawstring 34 causes the distal ends 26, 28 of first and second limbs 18, 20 to bend toward one another. First and second power cables 34*a* and 34*b* can be connected between the first and second rotatable members 30 and 32 rotatably mounted on distal ends 26 and 28 of upper and lower limbs 18 and 20, respectively. The power cables 34*a*, 34*b* assist a user with drawing back the drawstring 34 of the bow 10. When the drawstring 34 is released, the bent limbs 18, 20 spring back to a predrawn or undrawn position (and oscillate somewhat thereabout until such oscillations subside) such that the drawstring 34 returns to an undrawn position of the drawstring 34 and exerts a forward force on the arrow in the process which propels the arrow from the bow 10.

Referring to FIGS. 1-7, in one embodiment, a limb pad assembly 40 for an archery bow 10 includes an elongated body 50. The elongated body 50 is configured to space a limb 18 of the archery bow 10 from a first end 14 of a riser 12 of the archery bow 10 when the archery bow 10 is assembled. The limb 18 extends longitudinally (i.e., front to back or forward to rearward) when the archery bow 10 is assembled. The elongated body 50 has a working surface 56 configured to contact the limb 18 of the archery bow 10 when the archery bow 10 assembled. The surface 56 of the elongated body 50 is curved as the working surface 56 extends longitudinally (e.g., rearwardly or distally). In one embodiment, the working surface 56 is generally elliptical. In one embodiment, the elongated body 50 has 2 opposing working surfaces 56, and when assembled on the bow 10, only one working surface 56 of the elongated body 50 contacts the limb 18. The 2 opposing working surfaces are at least one of a different distance from the center of rotation of the elongated body 50 or have a different curvature.

In one embodiment, the elongated body 50 has an aperture 54 extending laterally therein. The aperture 54 is configured to receive a portion 44 of a member 41 therein such that the elongated body 50 is supported by the member 41 with respect to the riser 12 when the archery bow 10 is assembled. The elongated body 50 is rotatable about the portion 44 of the member 41 supporting the elongated body 50. In one embodiment, the elongated body 50 is configured to threateningly engage the portion 44 of the member 41 supporting the elongated body 50. In another embodiment, the portion 44 of the member 41 extends through the aperture 54 in the elongated body 50, and a cotter pin or snap ring is used to retain the elongated body 50 on the extension portion 44 of the member 41. In one embodiment, the elongated body 50 is rotatable about a lateral axis of the elongated body 50 when the archery boat 10 is assembled. In one embodiment, the lateral axis of the elongated body 50 is coextensive with a central axis 51 of a barrel member 41 and the extension portion 44 of the barrel member 41 when the bow 10 is assembled. In one embodiment, the limb pad assembly 40 further includes the barrel member 41 configured to engage the riser 12 and support the elongated body 50. The barrel member 41 includes the portion 44 configured to insert in the aperture 54 of the elongated body 50. In one embodiment, the elongated body 50 is rotatable about the lateral axis (e.g., centerline of generally cylindrical aperture 54) of the elongated body 50. In one embodiment, the lateral axis (e.g., axis of rotation) of the elongated body 50 is not centered with respect to a longitudinal cross-section of the elongated body 50. That is, when assembled, the lateral axis of the elongated body 50 is closer to a forward end of the elongated body 50 than a rear end of the elongated body 50 or closer to the rear end of the elongated body 50 than the front end. Additionally, the lateral axis may and aperture 54 may be closer to a top or bottom of the elongated body 50. The curvature of the working surface 56 and/or rotation of the elongated body 50 about the portion 44 of the member 41 served to allow the limb pad assembly 42 distribute stress over a larger portion of the limb 18 and adapt to a changing shape of the limb 18 as the limb 18 bends and flexes during drawing and firing of the bow 10. An uncentered lateral axis or axis of rotation of the elongated body 50 combined with a partial elliptical or parabolic curve of the working surface 56 of the elongated body 50 can serve to further distribute stress along the limb 18 is the limb 18 flexes throughout its range of motion during drawing of the bowstring 34 and release of the bowstring 34 or firing of the bow 10.

In one embodiment, the limb 18 is a first limb 18*a*, and the elongated body 50 is a first elongated body 50. Limb pad assembly 40 further includes a second elongated body 52 configured to space a second limb 18*b* from the first end 14 of the riser 12. That is, the limb pad assembly 40 includes two elongated bodies 50, 52 each dedicated to one limb 18*a*, 18*b* of a split limb compound archery bow 10. In one embodiment, the limb pad assembly 40 further includes a third elongated body configured to space a third limb from a second end 16 of the riser 12 and a fourth elongated body configured to space a fourth limb from the second end 16 of the riser 12. That is, the limb pad assembly 40 includes elongated bodies configured to space both the upper limb 18 and lower limb 20 of the archery bow 10 from the upper and lower ends 14, 16, respectively, of the riser 12. In one embodiment, the first and second elongated bodies 50, 52 are supported by a first barrel member 41 attached to the first end 14 of the riser 12, and the third and fourth elongated bodies are similarly supported by a second barrel member, substantially identical to the first barrel member, attached to the second end 16 of the riser 12. In one embodiment, the limb pad assembly 40 includes all of the first second third and fourth elongated bodies, and the first and second barrel members. The limb pad assembly 40 may also include fasteners configured to secure the barrel members 41 to the riser 12 through apertures 48 in the barrel members 41. In one embodiment, the barrel members 41 extends through holes 15 at the opposing ends of the riser 12 to secure the limb pad assembly 40 to the riser 12.

In one embodiment, an archery bow 10 includes a first limb pad assembly 40 and a corresponding second limb pad assembly substantially identical to the first limb pad assembly 40. The first limb pad assembly 40 spaces a split limb 18 from a first end 14 of the riser 12, and the second limb pad assembly similarly spaces a split limb 20 from a second end 16 of the riser 12. The archery bow 10 includes the riser 12 the two split limbs 18, 20 (i.e., four limbs in total), the bowstring 34, and a pair of cams or rotatable members 30, 32. The archery bow 10 may also include limb caps 36, 38 configured to secure the limbs 18, 22 the riser 12. It is also contemplated within the scope of the claims that the limb 18 includes the first limb cap 36 and the limb 20 includes the second limb cap 38.

Figure 2:
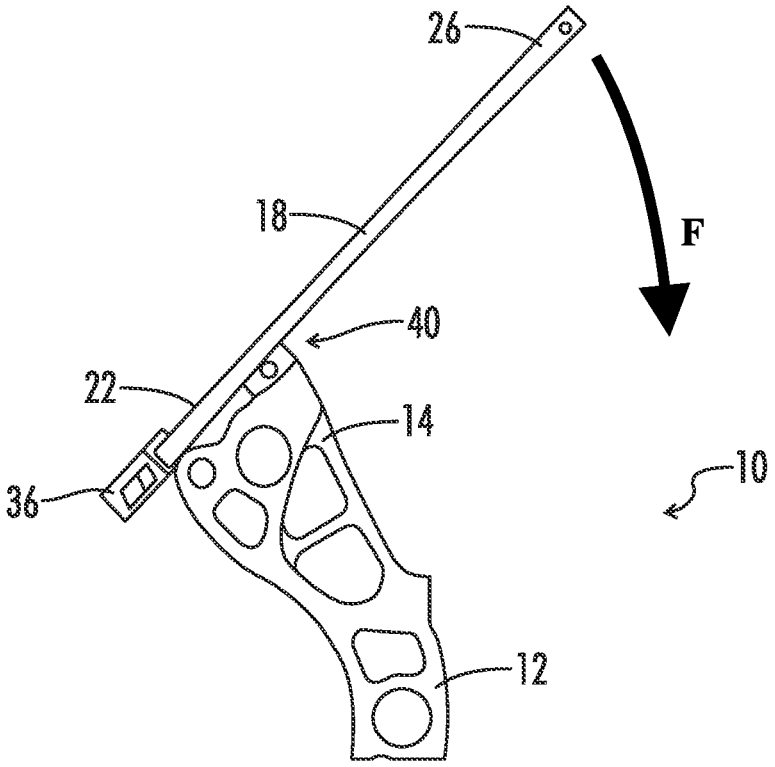
FIG. 2 is a side plan view of an upper portion of the compound archery bow of FIG. 1.

In one embodiment, a limb pad assembly 40 can include a barrel member 41 receivable in an end of a riser 12 for a bow 10, and a pair of shoe members 50, 52. The end 14 of the riser 12 can be contoured with a channel (not shown) to receive the barrel member 41. The barrel member 41 can have a generally cylindrical central portion 42 and a pair of generally cylindrical extension portions 44 (i.e., rods or shafts) extending axially from opposite lateral ends of the central portion 42. The central portion 42 can have a diameter that is greater than the diameter of the extension portions 44. In some embodiments, the barrel member 41 can include a hole or aperture 48 extending through the central portion 42 transverse to a lateral axis 51 of the central portion 42. The aperture 48 can be sized to receive a mechanical fastener (e.g., machine screw or bolt) for coupling the barrel member 41 to the end 14 of the riser 12 for the archery bow 10 as shown in FIG. 2. In some embodiments, the aperture 48 can be threaded to receive a screw for coupling the barrel member 41 to the riser 12. That is, the threads of a fastener may extend from the end 14 of the riser 12 into the aperture 48 to secure the barrel member 41 to the riser 12.

Figure 3:
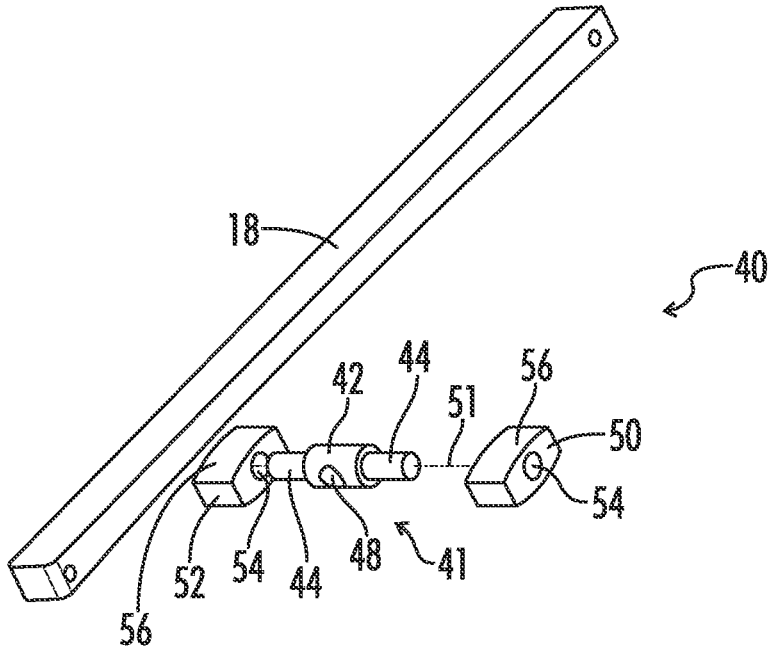
FIG. 3 is an isometric exploded view of the pivoting limb pad assembly and limb of FIG. 2.
Figure 4:
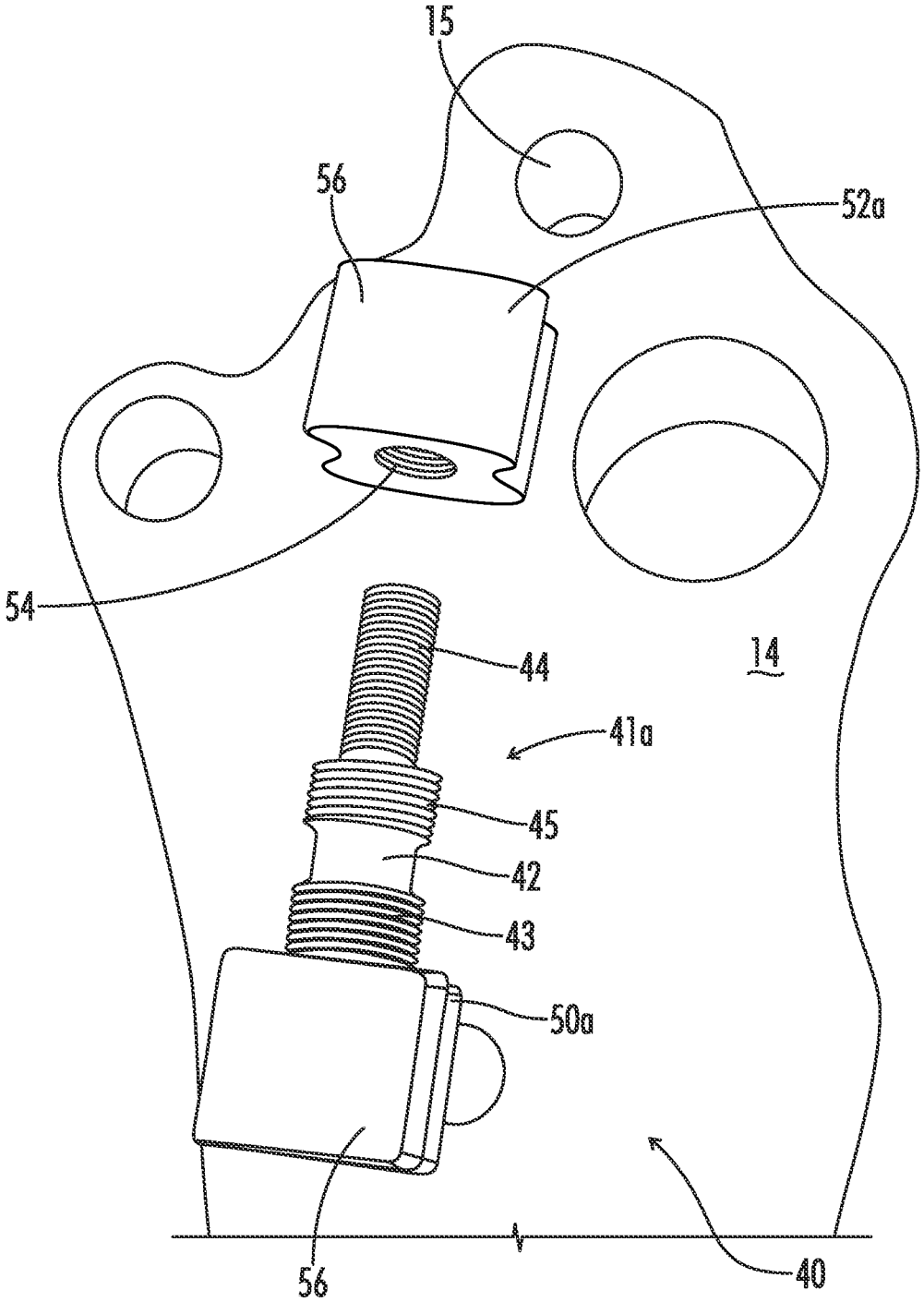
FIG. 4 is a top perspective view of a perspective view of a partially disassembled pivoting limb pad assembly and riser according to one embodiment of the invention.

The shoe members 50, 52 are elongated bodies with a curved longitudinal cross section. The curvature may be a roughly elliptical or ovoid cross section, as shown in FIG. 3. In other embodiments, the body of the shoe members 50, 52 can take different shapes. In one embodiment, the body of each shoe member 50, 52 includes a curved working surface 56 against which a limb of an archery bow is receivable as shown in FIGS. 2-3. The body of each shoe member 50, 52 can also include a first side opposite the working surface 56 from a second side, and a hole or aperture 54 sized to receive one of the extension portions 44 of the barrel member 41. The aperture 54 can extend completely through the body of each shoe member 50, 52 from the first side to the second side, or only partially though through the body from one side or the other. In one embodiment, each shoe member 50, 52 is rotatable about each extension portion 44 of the barrel member 41 when the extension portion 44 is received in the aperture 54 of each respective shoe member 50, 52. The aperture 54, as well as the extension portions 44 of the barrel member 41, can be threaded with complimentary threads to retain the shoe members 50, 52 on the extension portions 44 during rotation of the shoe members on the extension portions (i.e., while drawing and firing the bow 10).

In this way, when the barrel member 41 is coupled to a riser 12 of a bow 10 and a bow limb 18 is coupled to the riser 12 in such a way that a surface of the limb 18 contacts (e.g., overlies) the working surfaces 56 of the shoe members 50, 52 (as shown in FIG. 2), the shoe members 50, 52 can pivot about the extension portions 44 of the barrel member 41 with the limb 18 when the limb 18 flexes upon the application of force F during drawing of the bow 10. Put differently, a limb 18 coupled to a riser 12 of an archery bow 10 can pivot about the working surfaces 56 of the shoe members 50, 52 when the barrel member 41 is coupled to the riser 12 of the bow 10 and the limb 18 contacts or rests on the working surfaces 56 of the shoe members 50, 52 while the bow is drawn. In practice, this means that any change in draw weight or position of the drawstring 34 will cause the shoe members 50, 52 to pivot and thereby reduce the stress across the limb 18 and allow the bow 10 to maintain a safe limb pad angle while at rest or in use.

Referring to FIGS. 4-7, in one embodiment, the barrel member 41*a* is receivable in a hole or aperture 15 extending through an end 14 of the riser 12 to releasably couple the barrel member 41*a* to the riser 12. In such embodiments, the barrel member 41*a* is alike in all respects to barrel member 41 except as specifically set forth below. Barrel member 41*a* can be provided with one or more threaded sections 43, 45. These threaded sections 43, 45 can be complimentary to threads located in hole or aperture 15 of the riser 12. This aids in coupling the barrel member 41*a* to the riser 12. Notably, barrel member 41*a* does not include aperture or hole 48, as such mechanism of attachment to the riser 12 is unnecessary in light of threaded section 43, 45. Extension portions 44 can be threaded with threads complimentary to threads located in aperture 54 of the shoe members 50, 52. Threaded extension portions 44 aid in retaining the shoe members 50, 52 on the extension portions 44 during adjustment of the limb pad assembly 40 as described below. In one embodiment, the central portion of the barrel member 41 is threaded complimentary to threads in the hole 15 of the riser 12 such that the barrel member 41*a* may be secured to the riser 12 by screwing the barrel member 41, at least partially, into the hole 15 in the riser 12.

Figure 5:
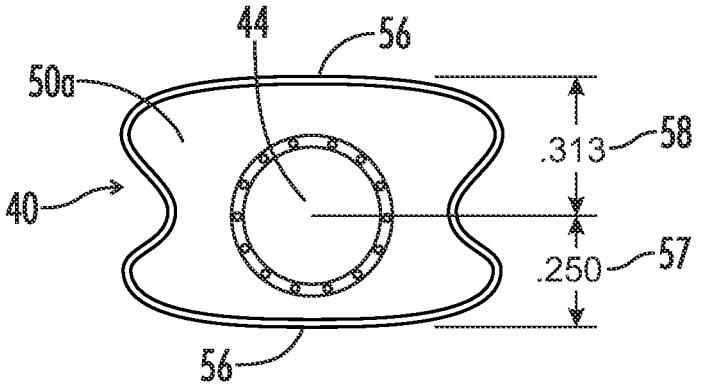
FIG. 5 is side perspective view of the assembled pivoting limb pad assembly of FIG. 4.
Figure 6:
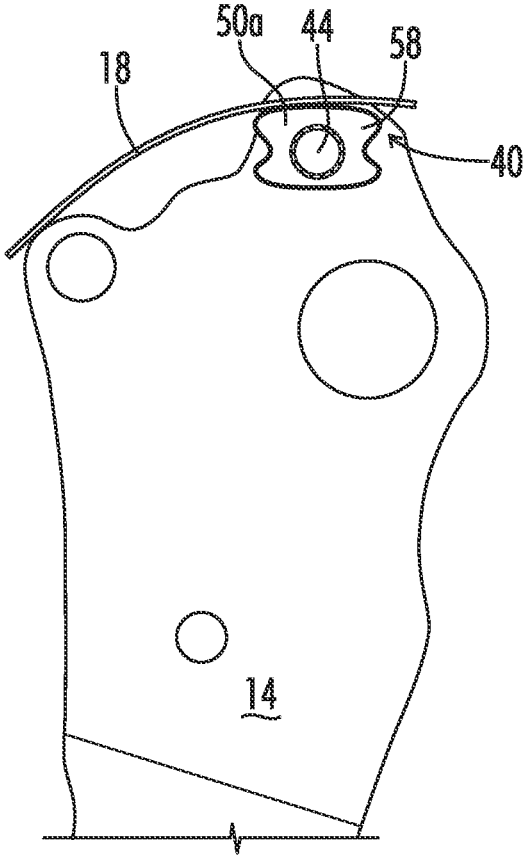
FIG. 6 is a side perspective view of the pivoting limb pad assembly of FIG. 4 assembled on the riser of FIG. 4 in a first configuration.
Figure 7:
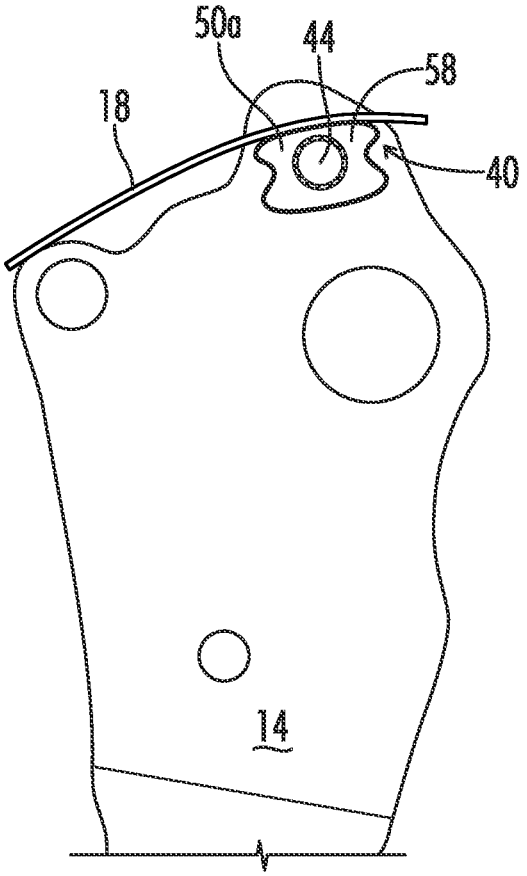
FIG. 7 is a side perspective view of the pivoting limb pad assembly of FIG. 4 assembled on the riser of FIG. 4 in a second configuration.

Referring again to the embodiments shown in FIGS. 4-7, shoe members 50*a*, 52*a* are alike in all respects to shoe members 50, 52. In one embodiment, shoe members 50*a*, 52*a* have an irregularly shaped cross section. As best shown in FIG. 5, shoe members 50*a* and 52*a* can have a first thickness 57 and a second thickness 58 that is larger than the first thickness 57. The "thickness" of the shoe member 50*a*, 52*a* refers to the distance between the geometric center of aperture 54 to the working surface 56 on either the upper or lower elongated exterior surfaces of shoe members 50*a*, 52*a*. Further, the upper and lower exterior surfaces may have different curvatures. In use, a user may adjust the draw weight and the limb angle of the bow 10 by selectably rotating the shoe member 50*a*, 52*a* about the extension portions 44 of the barrel member 41*a* (typically 180 degrees) so that the preferred working surface 56 of either thickness 57 or 58 of the shoe members 50*a*, 52*a* faces the adjacent limb 18. If the larger thickness 58 is turned to face each limb 18, the draw weight and limb angle of the bow will be increased. If the lesser thickness 57 is turned to face each limb 18, the draw weight and limb angle will be decreased. In this way, the pivoting limb pad assembly of the present disclosure allows a user to adjust draw weight without having to move the limb bolt (not shown) of the bow 10.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful PIVOTING LIMB PAD ASSEMBLY FOR AN ARCHERY BOW it is not intended that such references be construed as limitations upon the scope of this invention except as set forth in the following

What is claimed is:

1. A limb pad assembly of an archery bow, said assembly comprising:

an elongated body configured to space a limb of the archery bow from a first end of a riser of the archery bow when the archery bow is assembled, wherein:

the limb extends longitudinally when the archery bow is assembled;

the elongated body has a working surface configured to contact a limb of the archery bow when the archery bow is assembled; and the working surface of the elongated body is curved as the working surface extends longitudinally, wherein:

the limb is a first limb;

the elongated body is a first elongated body; and the limb pad assembly further comprises a second elongated body configured to space a second limb from the first end of the riser.

2. The limb pad assembly of claim 1, wherein:

the elongated body has an aperture extending laterally therein;

the aperture is configured to receive a portion of a member therein such that the elongated body is supported by the member with respect to the riser when the archery bow is assembled; and the elongated body is rotatable about the portion of the member supporting the elongated body.

3. The limb pad assembly of claim 1, wherein the elongated body is rotatable about a lateral axis of the elongated body when the archery bow is assembled.

4. The limb pad assembly of claim 1, further comprising:

a barrel member configured to engage the riser and support the elongated body.

5. The limb pad assembly of claim 1, wherein:

the limb pad assembly further comprises a barrel member configured to engage the riser and support the first elongated body and the second elongated body.

6. The limb pad assembly of claim 1, wherein the elongated body is rotatable about a lateral axis of the elongated body when the archery bow is assembled, and the lateral axis is not centered in the elongated body.

7. The limb pad assembly of claim 1, wherein in a vertical longitudinal cross section of the elongated body, the working surface has a generally elliptical curvature.

8. The limb pad assembly of claim 1, wherein:

the elongated body has an aperture extending laterally therein;

the aperture is configured to receive a portion of a member therein such that the elongated body is supported by the member with respect to the riser when the archery bow is assembled;

the elongated body is rotatable about the portion of the member supporting the elongated body; and the member threadingly engages the elongated body.

9. The limb pad assembly of claim 1, wherein:

the limb pad assembly further comprises a first barrel member configured to engage the riser and support the first elongated body and the second elongated body;

the limb pad assembly further comprises a third elongated body configured to space a third limb from a second end of the riser;

the limb pad assembly further comprises a fourth elongated body configured to space a fourth limb from the second end of the riser; and the limb pad assembly further comprises a second barrel member configured to engage the riser and support the third and fourth elongated bodies.

10. An archery bow comprising:

a limb pad assembly comprising:

an elongated body configured to space a limb of the archery bow from a first end of a riser of the archery bow when the archery bow is assembled, wherein:

the limb extends longitudinally when the archery bow is assembled;

the elongated body has a working surface configured to contact a limb of the archery bow when the archery bow is assembled; and the working surface of the elongated body is curved as the working surface extends longitudinally, wherein:

the limb is a first limb;

the elongated body is a first elongated body; and the limb pad assembly further comprises a second elongated body configured to space a second limb from the first end of the riser.

11. The archery bow of claim 10, wherein:

the elongated body has an aperture extending laterally therein;

the aperture is configured to receive a portion of a member therein such that the elongated body is supported by the member with respect to the riser when the archery bow is assembled; and the elongated body is rotatable about the portion of the member supporting the elongated body.

12. The archery bow of claim 10, wherein:

the elongated body is rotatable about a lateral axis of the elongated body when the archery bow is assembled.

13. The archery bow of claim 10, further comprising:

a barrel member configured to engage the riser and support the elongated body.

14. The archery bow of claim 10, wherein:

the limb pad assembly further comprises a barrel member configured to engage the riser and support the first elongated body and the second elongated body.

15. The archery bow of claim 10, wherein the elongated body is rotatable about a lateral axis of the elongated body when the archery bow is assembled, and the lateral axis is not centered in the elongated body.

16. The archery bow of claim 10, wherein in a vertical longitudinal cross section of the elongated body, the working surface has a generally elliptical curvature.

17. The archery bow of claim 10, wherein:

the elongated body has an aperture extending laterally therein;

the aperture is configured to receive a portion of a member therein such that the elongated body is supported by the member with respect to the riser when the archery bow is assembled;

the elongated body is rotatable about the portion of the member supporting the elongated body; and the member threadingly engages the elongated body.

18. The archery bow of claim 10, wherein:

the limb pad assembly is a first limb pad assembly;

the archery bow further comprises a second limb pad assembly;

the archery bow further comprises the riser;

the archery bow further comprises four limbs;

the archery bow further comprises a string; and the archery bow further comprises cams.

* * * * *